US006629911B2

(12) United States Patent
Cook

(10) Patent No.: US 6,629,911 B2
(45) Date of Patent: Oct. 7, 2003

(54) WEIGHTED EXERCISE GLOVE

(76) Inventor: Bob Cook, 2277 S. Kirkwood, #1002, Houston, TX (US) 77077

( * ) Notice: Subject to any disclaimer, the term of this patent is extended or adjusted under 35 U.S.C. 154(b) by 63 days.

(21) Appl. No.: 09/858,283

(22) Filed: May 15, 2001

(65) Prior Publication Data

US 2002/0128120 A1 Sep. 12, 2002

Related U.S. Application Data

(63) Continuation-in-part of application No. 09/803,120, filed on Mar. 9, 2001.

(51) Int. Cl.[7] ..... A63B 21/12
(52) U.S. Cl. ..... 482/105; 482/124; 482/83
(58) Field of Search ..... 482/83–90, 124, 482/105; 2/18, 261.1, 16; 446/267

(56) References Cited

U.S. PATENT DOCUMENTS 4,603,439 A * 8/1986 Golomb ..... 2/18
4,684,123 A * 8/1987 Fabry ..... 482/105
6,014,770 A * 1/2000 Spector ..... 2/18

* cited by examiner

*Primary Examiner*—Jerome W. Donnelly
(74) *Attorney, Agent, or Firm*—Welsh & Flaxman LLC

(57) ABSTRACT

Weighted exercise gloves shaped like boxing gloves. The shape and distribution of the weight about the gloves allows the user to have resistance weight at the end of his arms without having to grip the weight. The weight is equally distributed across the hands and lower forearms, and there is no requirement to grip the weight of the gloves, thus stress on the wrists is minimized.

20 Claims, 4 Drawing Sheets

WEIGHTED EXERCISE GLOVE

CROSS-REFERENCE TO RELATED APPLICATIONS

This application is a continuation-in-part of U.S. patent application Ser. No. 09/803,120, filed by Bob Cook on Mar. 9, 2001.

STATEMENT REGARDING FEDERALLY SPONSORED RESEARCH OR DEVELOPMENT

Not applicable.

BACKGROUND OF THE INVENTION

1. Field of Invention

This invention relates to a weighted exercise glove. Specifically, the invention describes a glove that is shaped, supported and padded like a boxing glove, with integral weight uniformly distributed over the generally dorsal (back) side of the glove and/or the wrist, allowing the palm of the glove to remain flexible to allow hinged motion of the thumb and finger portions of the glove. The glove may extend beyond the fingertips to completely cover the fingers, such as in a traditional boxing glove, or the fingertips may extend beyond the glove, as in a fingerless glove.

The invention allows the user to wear resistance weight applied to the upper extremities without having to grasp the weight. Rather than having to grasp resistance weight, such as a dumbbell, the user wears the weighted gloves. This prevents strain on the wrists, since there is no requirement to grasp and hold the weight. Rather, the weight is evenly distributed in a balanced manner across the distal portion of the arm, generally from the fingers to the forearm.

The invention is useful for those unable to grasp objects, heavy or light, due to wrist injuries, neurological injury or other diseases or injuries having such a condition. Since the user wears rather than holds the weight on his lower arms, resistance training is still possible for functional muscle groups, such as biceps, deltoids, trapezius, and other upper body and arm structures.

Even for exercisers not injured, the invention provides several advantages over conventional free and fixed station weights. Since the weight is not grasped, strain to the wrists is removed, even when a portion of the weight is distributed about the wrist, since tendons, ligaments and muscles in and about the wrist are not being used to affect hand and finger grip of the weight. Thus, the user is able to isolate and focus her strength training on the targeted muscle group, without having to provide energy and support to the wrists for the grip/grasp. This provides a more efficient workout while reducing the potential of acute or repetitive trauma wrist injury from hyperextension or other strain.

Other advantageous uses include those when performing shoulder shrugs, lunges, rows and lower body workouts where resistance weight is needed. As the weight is always being applied to the wearer's arms in a glove (which is preferably padded), there is less likelihood of bumping the body with a weight such as a dumbbell. This allows the user to focus on his form and targeted muscle groups affected by the exercise, rather than concentrating on the position of a free weight held in the hands or keeping the wrist straight. When using traditional free weights (dumbbells or barbells), the user is often directing a major portion of his attention, energy and effort towards maintaining proper wrist position to prevent injury from wrist strain and/or hyperextension. The present invention allows the user to focus instead on the targeted muscle group receiving resistance.

Additionally, the invention is useful as a boxing training aid. The shape and feel of the device are very similar to a traditional boxing glove. The extra weight allows the user to improve muscle mass while maintaining flexibility and range of motion during the workout. When the gloves are removed and replaced by traditional boxing gloves, the user is typically able to have greater hand speed since wearing the invention has strengthened the exact muscles used in boxing. In addition, when hitting a heavy bag with the preferred embodiment in which the gloves extend beyond the fingertips, the user feels less impact shock in his arms since the weight about the glove both disperses shock load and minimizes bounce-back from the bag due to inertial forces of the gloves.

When used for heavy weight training, the invention takes strain off the lower back because the hands are in a natural position. This is especially true when performing overhead military presses, since the body does not have to be tilted to clear the chin as required when lifting a barbell. With the present invention, the wearer if so desired can simply raise her hands straight up over her head with the palms facing forward to isolate and strengthen the deltoid muscle group. This is not possible with dumbbells, which requires the palms to be facing inward when lifting overhead in order to prevent the ends of the dumbbells from striking the sides of the user's head.

In the alternative embodiment, the gloves are weighted with replaceable water. This embodiment allows some flexibility in determining the weight of the gloves, and is especially useful if the gloves are transported, such as in the suitcase of a business traveler. The weighted gloves allow the traveler to have a full resistance weight workout in his room without carrying heavy weight in his luggage. Since water weighs approximately eight pounds per gallon (1.0 gm/ml) and is readily available, it can be filled into integral chambers of the gloves to provide the needed weight. Preferably, the water chambers are baffled to minimize sloshing and related fluid inertial forces.

2. Related Art

Weighted exercise gloves are found in the prior art. Some, such as Walker '433 (U.S. Pat. No. 4,911,433, issued Mar. 27, 1990) and Fredenhagen '853 (U.S. Pat. No. 3,838,853, issued Oct. 1, 1974) are for developing finger strength. These patents disclose weights on fingers of a glove, in order to increase finger strength for piano playing (Fredenhagen '853) or grasping a baseball bat (Walker '433). Neither is capable of supported heavy weights, and both create stress on the wrists.

Other weighted gloves include Guthrie '706 (U.S. Pat. No. 4,326,706, issued Apr. 27, 1981) and Schwartz '097 (U.S. Pat. No. 4,247,097, issued Jan. 27, 1981). These gloves have pockets for inserting weights. The main disadvantage of such designs is that in their disclosed embodiments the weights break out of their pockets, either from the pockets opening or the retaining material tearing, especially in fast exercises such as aerobic dancing and shadow boxing. More significantly, such devices still require, or at least encourage the user to grip palm weights, thus placing strain on the wrist, especially the carpal tunnel.

It would therefore be useful improvement of the prior art for a weight resistance glove to not have the limitations of the prior art, including those described above. Specifically, such a glove would conform comfortably and naturally to the neutral position of the hands, without requiring the user to grip the glove and its integrated weight.

BRIEF SUMMARY OF THE INVENTION

Accordingly, the objectives of this invention are to provide, inter alia, a new and improved weighted glove that:

provides upper body weight resistance without the need to grip the weight;

has weights that are integral, preferably permanently, to the glove to minimize breakage or disengagement of the weight from the glove;

has weight uniformly distributed across the hand and forearm to minimize wrist strain;

can alternatively be constructed to use water or other similar available fluids as weight; and is cost effective.

These objectives are addressed by the structure and use of the inventive device. Other objects of the invention will become apparent from time to time throughout the specification hereinafter disclosed.

DETAILED DESCRIPTION OF THE INVENTION

The present invention is described as a weighted glove 10, depicted in FIGS. 1 through 8.

Figure 1:
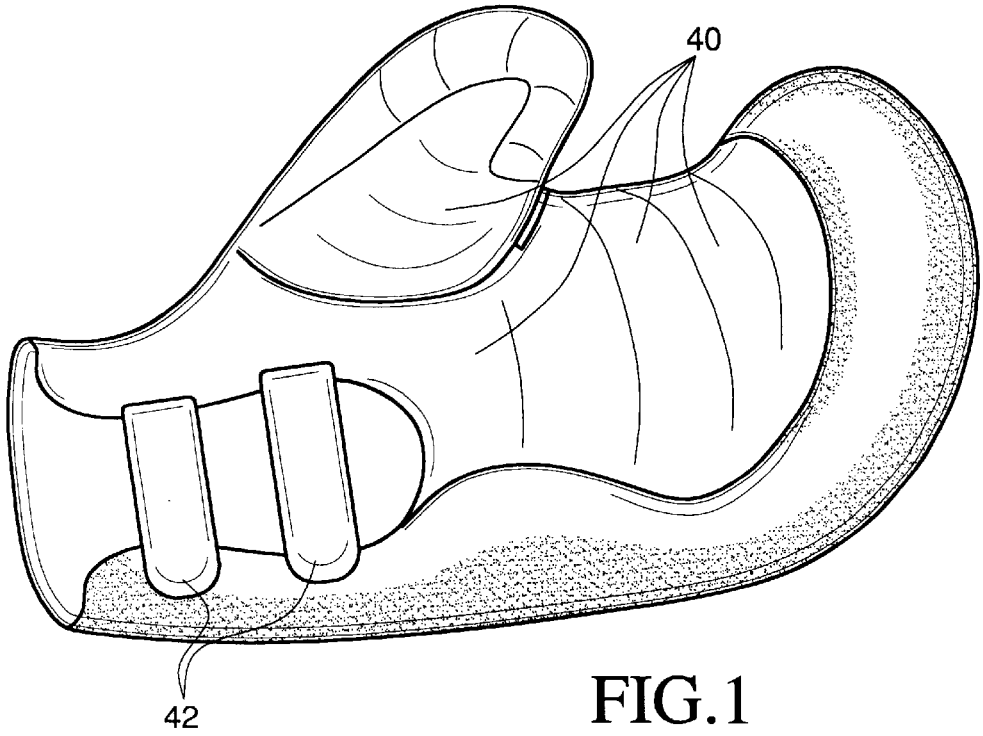
FIG. 1 depicts the palm side of the weighted glove, showing securement straps and the flexible palm.

As seen in FIG. 1, the shape of glove 10 is preferably that of a boxing glove, preferably a non-Corbett style of glove, having a mitten type area for the fingers and a separate thumb area. However, any shape glove providing natural support and shape for the hand is appropriate for the invention. The preferred glove 10 shown in FIG. 1 extends from past the wearer's fingertips (a first position distal the wearer's fingertips) to the forearm (a second position proximal the wearer's wrist) typically three or four inches to the proximal side of the wrist. The interior of the glove is preferably shaped and padded to provide a slight natural curve of the fingertips when the had is inserted. The glove preferably attaches to the hand with securements 42, which are Velcro™ type straps in the preferred embodiment. Alternatively, any securement method known in the art of athletic gloves may be used as securement 42, including but not limited to lacing, buckles, an elastic sleeve or zippers. Alternatively, no securement 42 may be used, and glove 10 stays on the user's hand due to the shape of the interior of glove 10 molding to the natural curvature and shape of the user's hands. Glove palm 40 comprises the portion of the exterior of glove 10 proximate the user's palm.

Figure 2:
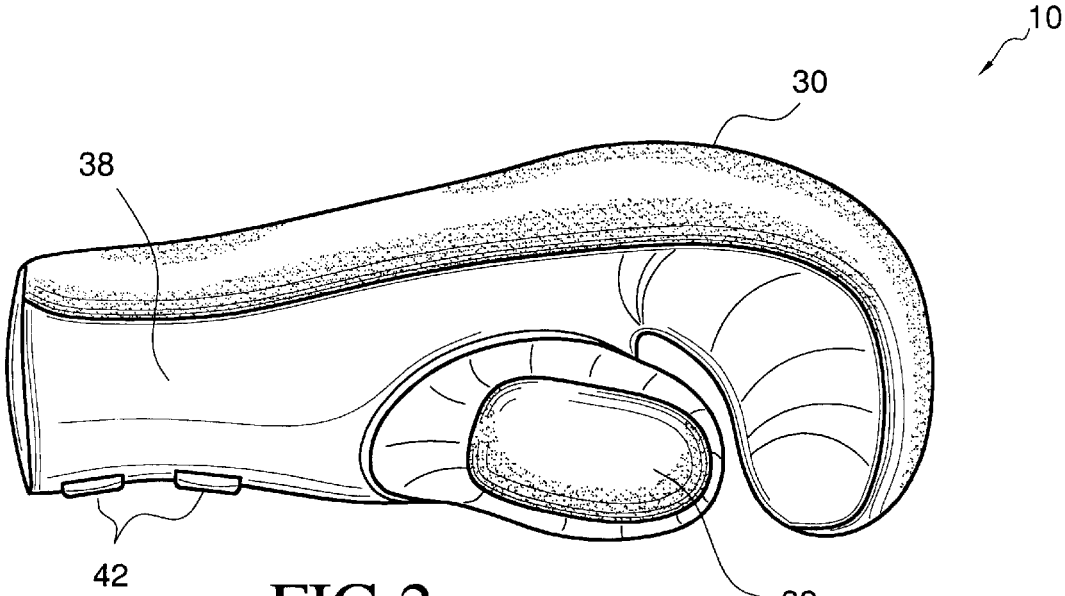
FIG. 2 depicts the inventive glove with integral molded weights in two sections, on the dorsal side of the glove and along the thumb.

One embodiment of glove 10 is shown in FIG. 2, having a dorsal weight 30 covering dorsal side 36 and a separate thumb weight 32 covering thumb dorsal area 31. Each weight is preferably a solid weight, preferably a singular flexible rubberized weight, preferably permanently secured under outer skin 38 of glove 10. Alternatively, dorsal weight 30 and thumb weight 32 may each comprise a plurality of smaller weights, secured in separate closed compartments (not shown) of skin 38. Alternatively, dorsal weight 30 and thumb weight 32 may be removable, by being secured in a pocket or other similar restraint (not shown) of glove 10. These removable weights may be a singular flexible rubberized weight or its equivalent, or the removable weights may be a plurality of smaller weights.

Figure 3:
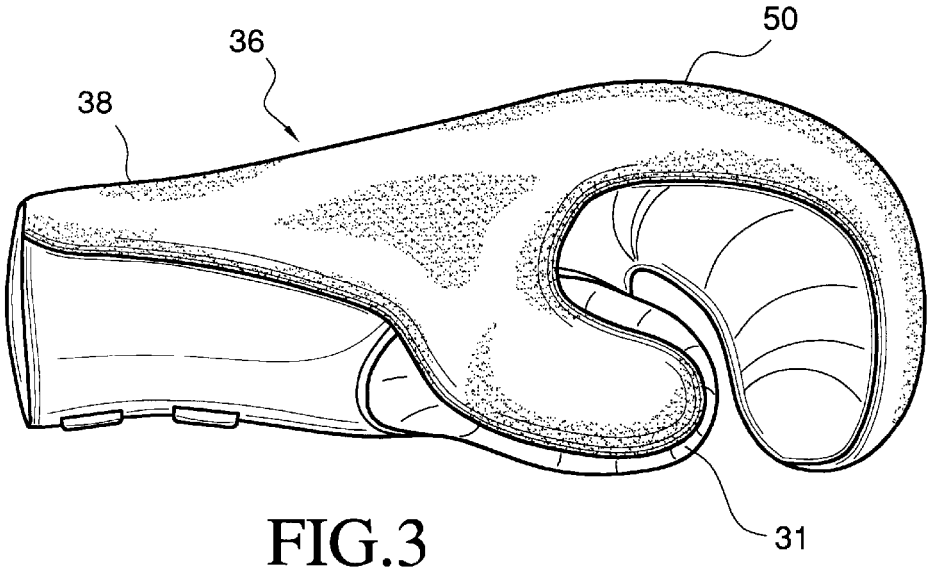
FIG. 3 depicts the preferred embodiment of the glove, with a unitary molded weight integral with the glove, preferably under the outer skin of the glove.

The preferred embodiment of glove 10 is shown in FIG. 3. A single unitary weight 50 is molded about dorsal side 36 of glove 10, also covering thumb dorsal area 31. Analogous to the weight described in FIG. 2, unitary weight 50 is preferably a singular flexible rubberized weight, secured under outer skin 38 of glove 10. Unitary weight 50 is preferably permanently secured under outer skin 38, but may be removable in an alternate embodiment. Alternatively, unitary weight 50, while still unitary in that it contiguously molds about dorsal side 36 of glove 10, may comprise a plurality of smaller weights secured in closed compartments (not shown) of skin 38. These closed compartments are typically sewn pockets that are stitched closed, to prevent the release of unitary weight 50, whether a single piece of weight or a plurality of smaller weights. Alternatively, these closed compartments may be pockets or similar compartments that can be accessed to remove and replace different amounts of weights in glove 10. Unitary weight 50 is shown covering only a portion of dorsal side 36 and thumb dorsal area 31. However, it is understood that weight 50 can cover all of the area of dorsal side 36 and thumb dorsal area 31 in this preferred embodiment.

Figure 4:
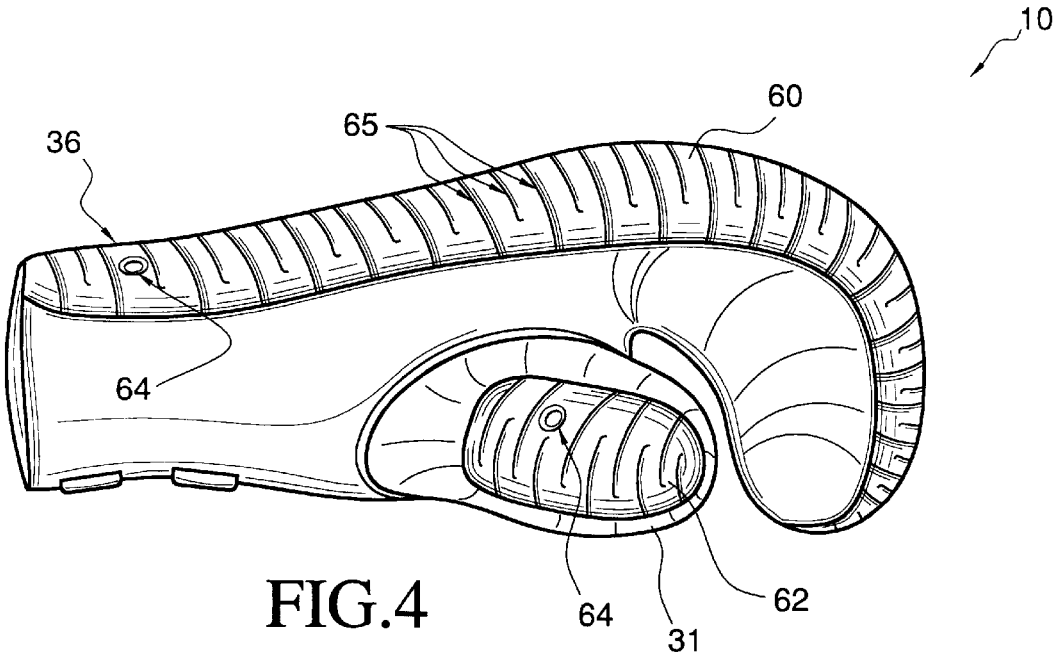
FIG. 4 depicts an alternative embodiment of the glove, having a chambered fluid container on the dorsal side of the glove and along the thumb.

An alternative embodiment of glove 10 is shown in FIG. 4, where dorsal weight 30 and thumb weight 32 are replaced with dorsal fluid chamber 60 and thumb fluid chamber 62 respectively. These chambers are capable of being filled with fluid, such as water, through at least one fill tab 64. Fill tabs 64 are any type of valve known in the art for allowing fluid to be selectively filled into or drained out of the fluid chambers. The chambers preferably have internal baffles 65, to prevent the fluid from sloshing and creating fluid inertial forces when the gloves are moved quickly. The chambers are depicted in FIG. 4 as segregated units. However, dorsal fluid chamber 60 and thumb fluid chamber 62 may combine and join to form a unitary fluid chamber (not shown) that covers all or part of dorsal side 36 and thumb dorsal area 31. Typically, the interior of this unitary fluid chamber is all in fluid communication within itself.

Figure 5:
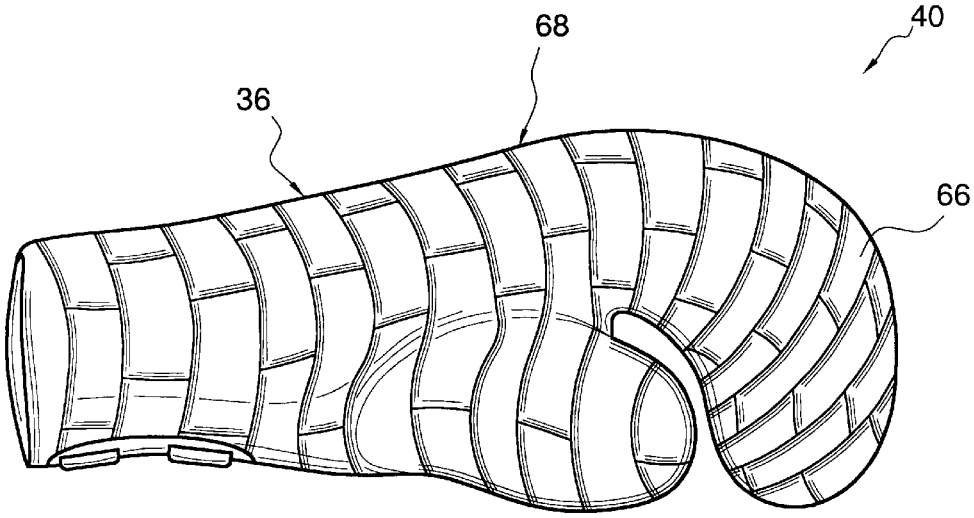
FIG. 5 depicts an alternative embodiment of the glove, having a continuous fluid chamber or weighted material surrounding the glove.
Figure 8:
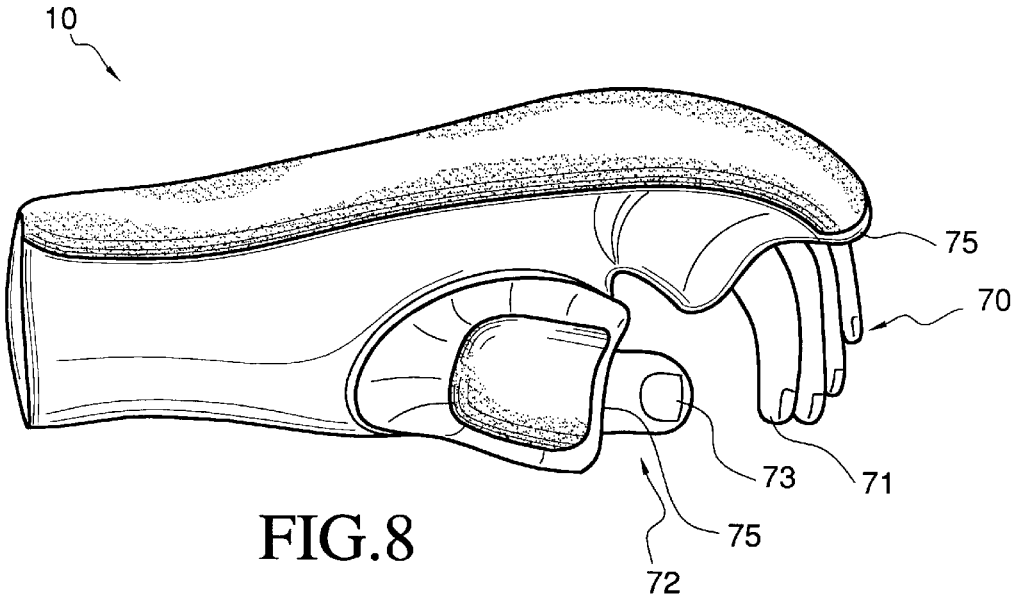
FIG. 8 depicts an alternative embodiment of the glove, wherein the fingers and thumb extend beyond the distal end of the glove.

Another preferred embodiment of glove 10 is shown in FIG. 5. In this embodiment, unibody fluid chamber 66 is the full weight 68, which covers the entire glove 10 under skin 38, including dorsal side 38, thumb dorsal area 31 and glove palm 40. The hand of the user fits into the interior of glove 10, which is surrounded by unibody fluid chamber 66. This embodiment allows an additional fluid capacity of glove 10, but limits its flexibility. The interior of glove 10 is still shaped to fit the natural contour of the user's hand. Alternatively, full weight 68 of glove 10 can be provided by a single flexible solid weight (not shown) that surrounds dorsal side 36, thumb dorsal area 31 and glove palm 40 and is secured, permanently or removably, under skin 38. While such an embodiment further limits the flexibility of the glove, this additional weight is uniformly supported about the glove.

Figure 6:
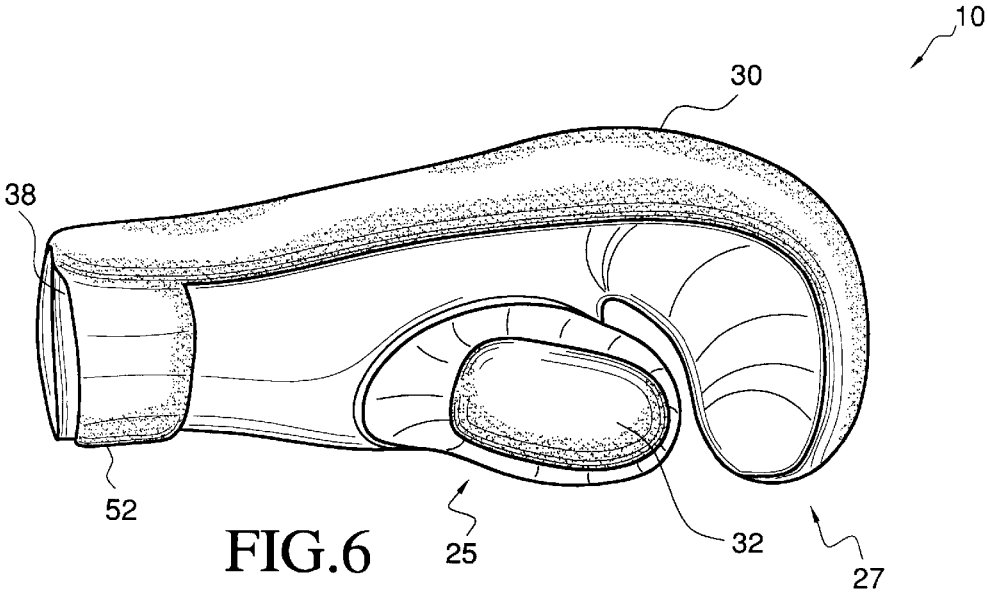
FIG. 6 depicts an alternative embodiment of the glove, having additional weight about the wrist.
Figure 7:
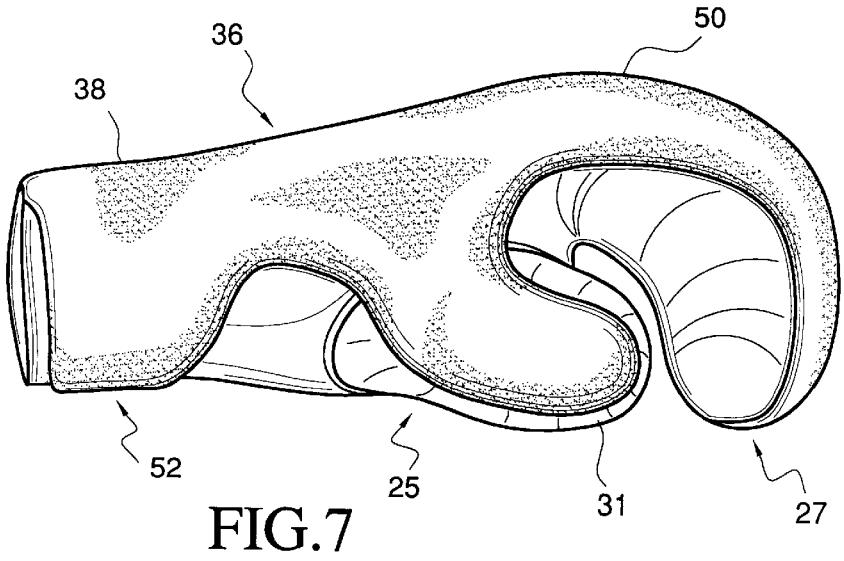
FIG. 7 depicts an alternative embodiment of the glove, having a unitary molded weight, including weight about the wrist area, which is integral with the glove, preferably under the outer skin of the glove.

Alternatively, glove 10 may include wrist weight 52, which forms around the wrist area of the user, as depicted in FIGS. 6 and 7. In these embodiments, either with segregated weights (FIG. 6) or a unitary weight 50 (FIG. 7), there is still minimal strain on the wrist, since the wrist is not being required to support the biomechanics required for grasping/gripping a weight. However, in these embodiments, it is still preferred that glove palm 40 (shown in other figures) remain flexible, to allow glove thumb 25 and glove fingers area 27 to hinge in conformance to the natural curvature and movement of the user's hand, especially his fingers and thumb. This natural hinging position keeps the glove on the hand without extra gripping/grasping by the user. Therefore, although wrist weight 52 may obstruct and even prevent securement 42, glove 10 stays on the user's hands due to the natural curvature of the hands mating with the hinged curvature of glove 10.

Alternatively, glove 10 can have user fingers 70 and user thumb 72 extend beyond glove distal end 75, to allow the user to flex his digits and keep them cooler, such that glove 10 is oriented between a first position anatomically proximal to user's fingertips 71 and/or user thumb end 73, and a second position anatomically proximal the wearer's wrist (not shown). Weight is distributed across the user's hand as in other embodiments, and the user still does not have to grip or grasp the weight of glove 10, since glove 10 conforms to the natural shape of the user's hand as above. Glove 10 in this embodiment may also incorporate wrist weight 52 (not shown in this figure), and/or may utilize the unitary weight 52 and/or unibody fluid chamber 66 described above.

In all embodiments, glove 10 is preferably padded both inside glove 10 as well as under skin 38. The interior padding aids in shaping the hand of the wearer to a natural position, preferably with the fingers slightly bent. The exterior padding under skin 38 provides additional safety if the gloves 10 should be dropped on the user when removed, or if they should be bumped against the wearer during the workout routine.

OPERATION

While all gloves 10 depicted are a single left-handed glove, it is understood that it is the intention of the inventor that gloves typically come in and are used in matching right and left handed pairs, assuming the wearer is capable and so desires such bilateral use.

The user places one or both hands in a corresponding glove 10. The gloves are secured to the hands and lower forearms of the user by engaging securement 42. Additional securement is afforded by the curved and slightly padded shape of glove palm 40. Alternatively, the user does not use or glove 10 does not have securement 42, but glove 10 remains on the user's hands due to the natural mating together of the user's hand and the interior of glove 10. As the user slips her hands into the glove, the interior cavity of glove 10 forms around the hands to hold gloves 10 on even when the hands are held in the downward position. If the user chooses to flex glove palm 40, she may do so, but this is typically not necessary to hold gloves 10 on.

The user then exercises in the same way she would exercise with dumbbells or barbells. For example, bicep curls are performed by lifting the arms upward as if holding a barbell or dumbbells. However, the hands do not have to grip gloves 10, since they are strapped onto the hands and lower forearms. The hands should remain in an ergonomically neutral position, with the fingers slightly curled. The wrist is held straight by the shape of and support provided by glove 10.

Lunges are likewise performed as if holding dumbbells. The gloves 10 do not pose striking hazards to the user, unlike dumbbells, which may hit the user when exercising. Likewise, exercises that traditionally use barbells, such as overhead military presses or bench presses, can be performed with gloves 10 on and simply pushing the weighted gloves 10 away. This provides a safer exercise, since the weights can not be dropped.

Boxer training is also improved with gloves 10. The user can shadow box or even hit a speed bag with gloves 10 on. These routines use the same muscles and range of motion of boxing, thus targeting the specific muscles that need to be strengthened for the sport. By increasing the muscle strength while maintaining the muscle flexibility offered by the range of motion of the shadow boxing routine, the boxer's speed will be increased as muscle strength increases without loss of flexibility. In the preferred embodiment, the weights are integral to gloves 10 and are not in pockets that may open, thus the weights remain firmly secured to gloves 10. Thus there is minimal danger of the weights flying out of gloves 10 during rapid movement, such as in shadow boxing or aerobic dancing. In addition, when hitting a heavy bag, the user feels less impact shock in his arms since the weight about glove 10 both disperses shock load and minimizes bounce-back from the bag due to inertial forces of the gloves. If the weights are replaceable in pockets (not shown) about gloves 10, the pockets preferably are secured firmly to prevent inadvertent release of the weights.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. An exercise weighted glove comprising:

a dorsal side, a thumb dorsal area, a wrist area and a glove palm;

said dorsal side, said thumb dorsal area, said wrist area and said glove palm sharing an external skin of said glove;

a non-foam solid flexible weight surrounding said dorsal side, said thumb dorsal area, said wrist area and said glove palm; and said weight being secured under said external skin.

2. The glove as in claim 1, said weight comprising a single flexible solid weight.

3. The glove as in claim 1, said weight comprising a plurality of solid weights.

4. The glove as in claim 1, further comprising said glove being oriented between a first position anatomically distal to a wearer's fingertips and a second position anatomically proximal said wearer's wrist.

5. The glove as in claim 1, further comprising said glove being oriented between a first position anatomically proximal to a wearer's fingertips and a second position anatomically proximal said wearer's wrist.

6. The glove as in claim 1, said weight being permanently secured under said external skin.

7. A weighted exercise glove, comprising:

a glove body configured to accommodate a user's hand in a neutral position, said glove body including a dorsal side, a palm side, and a wrist area;

a non-foam solid flexible weight integrally positioned within the dorsal side and wrist area of the glove body, while permitting the palm side of the glove to remain flexible.

8. A glove as in claim 7, wherein the weighted exercise glove is configured as a boxing glove.

9. A glove as in claim 7, wherein the interior of the glove body is shaped to accommodate the natural curve of a user's fingers, thereby permitting a user to exercise with said weighted exercise glove without gripping.

10. A glove as in claim 7, wherein the glove body includes a finger portion that accommodates the user's fingers, and a thumb portion that accommodates the user's thumb.

11. A glove as in claim 10, wherein the thumb section includes a dorsal side, and wherein said glove also includes a weight integrally located in the dorsal side of said thumb section.

12. A glove as in claim 10, wherein the thumb portion includes an aperture that permits a user's thumb to extend beyond the distal end of the thumb portion.

13. A glove as in claim 10, wherein the finger portion includes an aperture for each finger, thereby permitting the user's fingers to extend beyond the distal end of the finger portion.

14. A glove as in claim 7, wherein the weight comprises a singular flexible rubberized weight that extends throughout the dorsal side and the wrist area.

15. A glove as in claim 7, wherein the interior of said glove body is shaped and padded to provide a natural support and shape for a user's hand.

16. A glove as in claim 7, wherein the weight comprises a plurality of weights secured in separate cased compartments within an outer skin on the dorsal side and wrist area of said glove body.

17. A glove as in claim 7, wherein said glove includes padding between the integral weight and an outer skin.

18. A glove as in claim 8, further comprising a weight integrally placed in the palm section of the glove.

19. A glove as in claim 7, further including a finger portion and a thumb portion wherein said finger portion and said thumb portion include an aperture for each finger and thumb to permit a user's fingers to extend beyond the distal end of the finger portion and a user's thumb to extend beyond the distal end of the thumb portion.

20. A weighted exercise glove, comprising:

a glove body configured to accommodate a user's hand in a neutral position, said glove body including a dorsal side and a palm side;

a non-foam flexible solid weight integrally positioned within the dorsal side of the glove body, while permitting the palm side of the glove body to remain flexible.

* * * * *